United States Patent [19]

Alger

[11] Patent Number: 4,751,646

[45] Date of Patent: Jun. 14, 1988

[54] METHOD FOR DETERMINING ORIGINAL SATURATIONS IN A PRODUCED FIELD

[75] Inventor: Robert P. Alger, Buchanan Dam, Tex.

[73] Assignee: Restech, Inc., Houston, Tex.

[21] Appl. No.: 863,451

[22] Filed: May 15, 1986

[51] Int. Cl.[4] ..... G01N 15/08; E21B 49/02

[52] U.S. Cl. ..... 364/422; 73/153; 324/376

[58] Field of Search ..... 73/153, 38; 364/422; 324/376

[56] References Cited

U.S. PATENT DOCUMENTS

| | | | |
|---|---|---|---|
| 4,211,106 | 7/1980 | Swanson | 73/38 |
| 4,506,542 | 3/1985 | Rose | 73/38 |
| 4,644,283 | 2/1987 | Vinegar et al. | 324/376 |
| 4,648,261 | 3/1987 | Thompson et al. | 73/38 |

*Primary Examiner*—Charles E. Atkinson
*Assistant Examiner*—Clark A. Jablon
*Attorney, Agent, or Firm*—Dodge, Bush & Moseley

[57] ABSTRACT

For a formation zone of a well, a method for determining the relationship between bulk volume of oil $\phi_o$ as a function of total effective formation porosity $\phi_E$ and height h above the oil water contact from capillary pressure data of a core taken from the formation of the well is disclosed. The disclosed relationship of the form, $$\phi_o = C\phi_E - K + g \log h$$

where C, K and g are constants derived from the capillary pressure data of the core and the relationship between h and the capillary pressure is affected by the relative densities of the connate water of the zone and the oil in the zone. In a well which has been produced and no $\phi_E$ log exists, the original bulk volume of $\phi_o$ is determined from the $R_t$ log in cooperation with the core data relationship between $\phi_o$, $\phi_E$ and h through the relationship, $$\phi_o(h) = \frac{1}{1-C}\left[C\left(\frac{R_w}{R_t(h)}\right)^{\frac{1}{n}} - K + g \log h\right],$$

9 Claims, 3 Drawing Sheets

FIG. 1
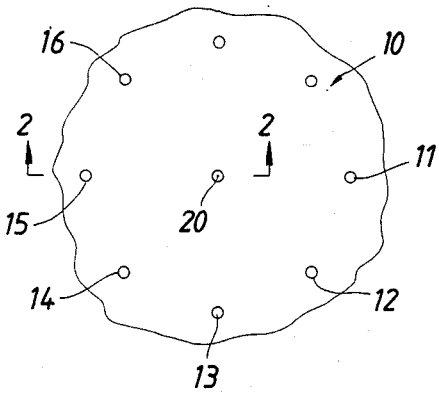
FIG. 2
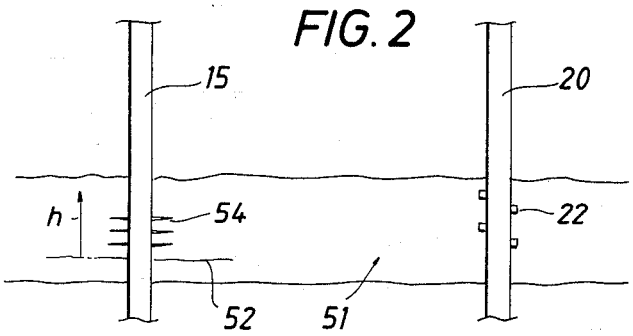
FIG. 3A
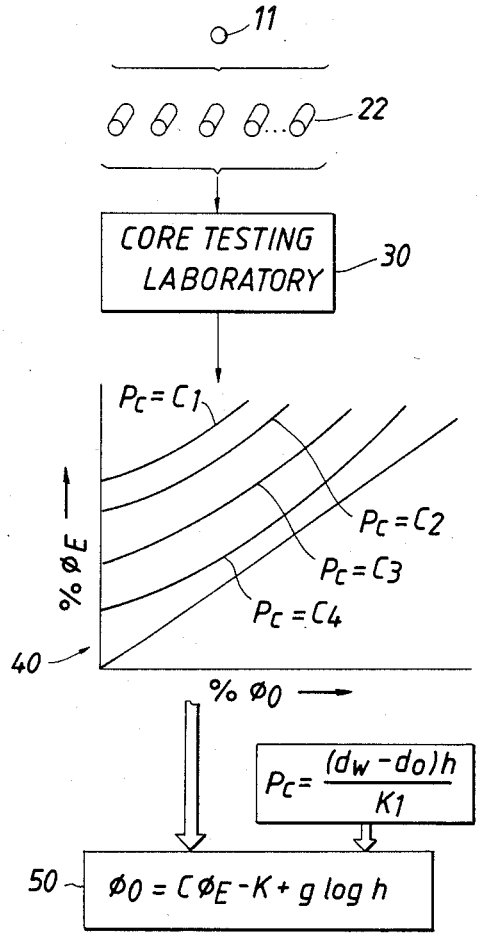
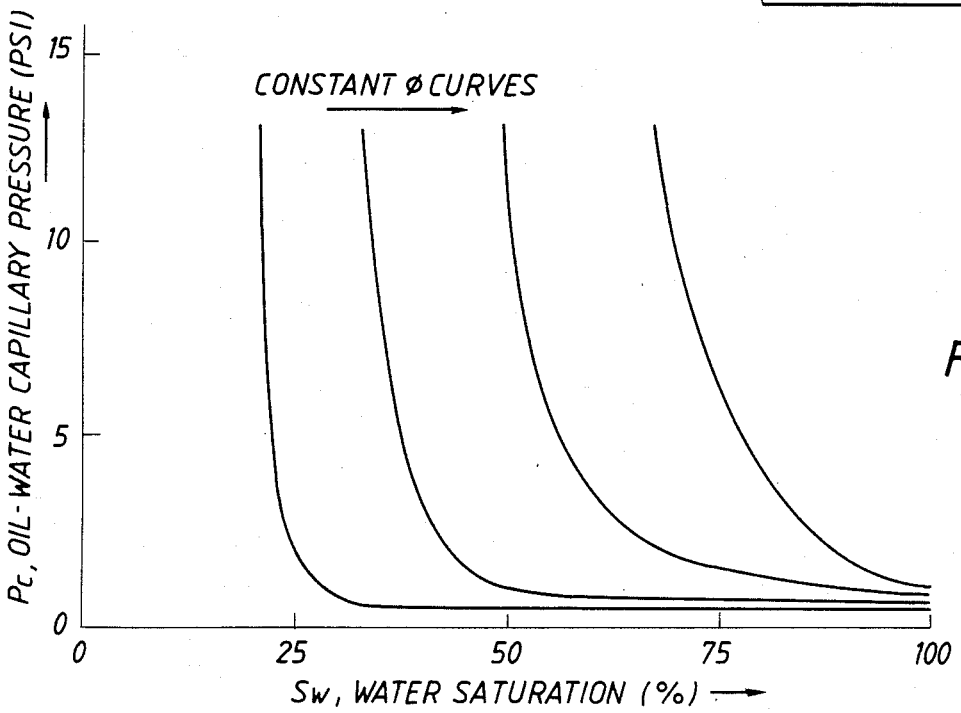
FIG. 3B

METHOD FOR DETERMINING ORIGINAL SATURATIONS IN A PRODUCED FIELD

BACKGROUND OF THE INVENTION

1. Field of the Invention

This invention relates in general to a method for determining from core data the original bulk volume of oil as a function of effective porosity and height above the oil-water contact point for a well that has been in production. In particular the invention relates to a method for determining and recording as a function of depth, the original bulk volume of oil and saturations of a produced well using core data, and where an original porosity log does not exist, combining information from an original resistivity log to determine and record original bulk volume of oil and saturation.

2. Description of the Prior Art

A paper by G. M. Heseldin entitled "A Method of Averaging Capillary Pressure Curves" published in the SPWLA Fifteenth Annual Logging Symposium, June 2–5, 1974 describes a method for determining an average capillary pressure curve for a particular rock type. Heseldin describes how capillary pressure data from a number of core samples of a zone of the formation can be measured and plotted with constant capillary curves $P_c=K$ on an x−y grid where total effective porosity $\phi_E$ is measured on the x ordinate and bulk volume of oil, or $\phi_o$ is plotted on the y-abscissa. Heseldin describes a method of characterizing any curve as a displaced rectangular hyperbola of the form, $$(\phi_E-A)^2=(\phi_o)^2+B^2,$$

and then shows that the constants A and B are essentially linear with the logarithm of capillary pressure $P_c$.

A disadvantage of the Heseldin approach is that no single relationship is established by which the bulk volume of oil $\phi_o$ may be expressed as a function of effective porosity and capillary pressure $P_c$.

Identification of Objects of the Invention

It is an object of the invention to provide a method for determining a single function by which bulk volume of oil $\phi_o$ is related to the effective porosity $\phi_E$ and capillary pressure $P_c$ or height above the oil-water contact level in a zone of a hydrocarbon bearing reservoir which is obtained from capillary pressure analysis of a plurality of cores from that zone.

It is another object of the invention to apply the determined bulk volume of oil $\phi_o$ relationship to wells for which no porosity log $\phi_E$ exists, but where resistivity logs were obtained prior to production.

SUMMARY OF THE INVENTION

The objects, advantages and features of the method are incorporated in a method for determining the bulk volume of oil as a function of depth and effective porosity in a zone of a produced well. The first step of the method is to obtain core samples from a zone corresponding to the zone of a produced well. Usually this step includes forming a test bore in proximity to the produced well and obtaining a plurality of cores from the zone corresponding to the pay zone in the produced well. The core samples are laboratory tested to determine the relationship of bulk volume of oil $\phi_o$ as a function of capillary pressure $P_c$ and effective porosity $\phi_E$, that is $\phi_o=F(\phi_E, P_c)$.

Next the relationship between capillary pressure $P_c$ and height h above the oil-free water contact of the zone is determined of the form, $$h=\frac{K_1P_c}{d_w-d_o}$$

where $d_w$ is the density of the connate water of the zone, $d_o$ is the density of oil in the zone, and $K_1$ is a constant of proportionality.

Next a second relationship of the form $$\phi_o=C\phi_E-K+g\log h$$

is determined from the core data and the relationship between $P_c$ and h. A log of $\phi_o(h)$ is then recorded from the second relationship by combining $\phi_E(h)$ data from a log of effective porosity of the zone.

Where a log of $\phi_E(h)$ was never obtained for the produced well, but a resistivity $R_t(h)$ exists for the well before it was produced, the second relationship described above can be rearranged to the form, $$\phi_o(h)=\frac{1}{1-C}\left[C\left(\frac{R_w}{R_t(h)}\right)^{\frac{1}{n}}-K+g\log h\right]$$

where $R_w$ is the resistivity of connate water of the zone, and n is a constant. The $R_t(h)$ log is then used with the relationship above to derive and record a log of original bulk volume of oil $\phi_o$ as a function of height above the oil-water contact level.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown of which:

FIG. 1 is a plan view of an oil field in which a number of producing oil wells have been formed with one test well also being formed in the field;

FIG. 2 is a schematic illustration of a partial cross-section through the field showing a producing well through a pay zone and showing a test well through the pay zone in which core samples have been taken at varying depths through the zone;

FIG. 3A is a flow-chart type illustration showing steps required to develop the relationship of bulk volume of oil $\phi_o$ as a function of effective porosity and height above the oil-water contact level;

FIG. 3B shows a typical set of laboratory capillary pressure curves for four core samples of varying porosity.

DESCRIPTION OF THE INVENTION

Figure 3C:
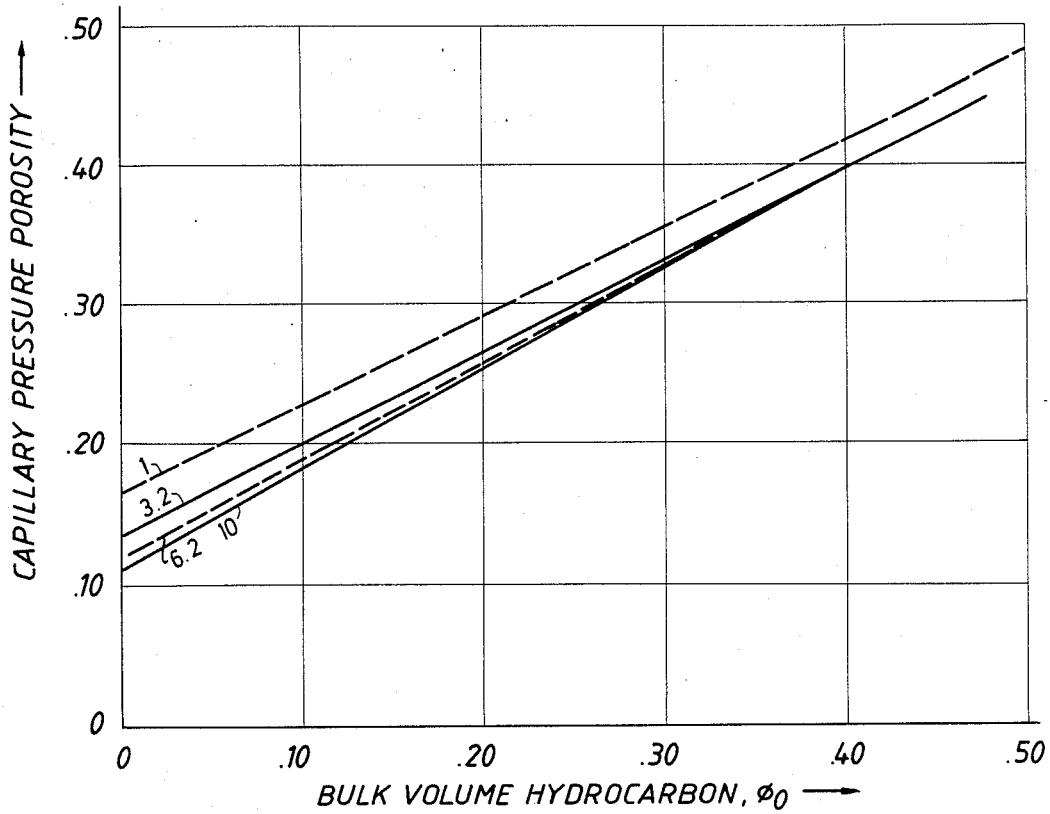
FIG. 3C is a graph of porosity versus bulk volume of oil for various levels of capillary pressure of a producing oil field and FIG. 3D is a graph showing the relationship between the height above the oil-water contact of a pay zone and an "intercept" developed for the relationship between bulk volume of oil and capillary pressure and said height.

Many major oil fields were brought on production without adequate information as to the correct hydrocarbon volume originally present. While most wells were logged by an electrical log or survey, porosity logs were not yet developed and sidewall coring gave questionable results. This invention relates to running modern well logs and performing special core analysis procedures to evaluate current and original bulk volume of oil and correlative oil saturation for each individual well in the field.

FIG. 1 illustrates an oil field 10 in which produced wells 11–18 are shown and in which a test well 20 has been formed. FIG. 2 shows a cross-section through the formation pay zone 51 and illustrates old well 15 which has been cased, cemented and perforated by means of perforation 54. The oil-water contact level 52 is illustrated in pay zone 51 from which height h above that contact is measured and discussed in more detail below. The test well 20 is illustrated as extending through pay zone 51 and cores 22 are schematically illustrated as being taken from that zone.

FIG. 3A shows that the method according to the invention includes performing capillary pressure tests on the cores which have a range of bulk volume of oil $\phi_o$, capillary pressure $P_c$ and effective porosity $\phi_E$. Typically, the data obtained as suggested by the curves of FIG. 3A are obtained by pumping mercury into each sample. Mercury saturation is calculated as a percentage of pore volume in terms of pressures in order to establish capillary pressure curves by mercury injection (Purcel method). The testing procedure is described at pages 94–97 in a book, Properties of Reservoir Rocks: Core Analysis, by Robert P. Monicard, Gulf Publishing Company, Houston, Tx. 1980.

The functional relationship between $\phi_E$ and $\phi_o$ and $P_c$ is combined according to the invention and as indicated in FIG. 3A, with the relationship between capillary pressure and height above the oil-water contact level 52 to produce the relationship, $\phi_o = C\phi_e - K + g \log h$, where C, K and g are constants depending on the formation characteristics of the formation zone and the constants $d_w$, $d_o$ and $K_1$ represent respectively the density of connate water in the zone, density of oil in the zone and a constant of proportionality. The development of the relationship between $\phi_o$, $\phi_E$ and h is best explained by way of an actual example.

Capillary pressure data for 17 levels for the 5800 foot sand of the Tom O'Connor Field in Texas were tabulated for four different pressures (1.0, 3.2, 6.2, & 10 psi). FIG. 3B illustrates the laboratory capillary pressure curves for four samples. Values of water saturation $S_w$ are extracted for given $P_c$ levels for each sample. From the porosity and $S_w$, bulk volume of oil; BVH or $\phi_o$, is calculated:

$$BVH = \phi_o = \phi(1 - S_w).$$

FIG. 3C is a graph created from the data of FIG. 3B but shows the porosity $\phi$ plotted versus bulk volume of oil for selected $P_c$ values of $P_c$—1.0, 3.2, 6.2 and 10 psi.

Linear relations between $\phi$ and BVH for each $P_c$ were developed. The resulting equations were:

| $P_c$ | BVH = |
|---|---|
| 1.0 | 1.5753 $\phi$ - .26005 |
| 3.2 | 1.5156 $\phi$ - .20785 |
| 6.2 | 1.4164 $\phi$ - .16667 |
| 10.0 | 1.3607 $\phi$ - .14480 |

FIG. 3C shows the plotted data for $P_c = 1.0$ and lines were added for the three other equations. Parallelism among the curves, i.e., common slopes of the linear equation is not perfect when $P_c$ is high. It is therefore necessary to normalize the equations. An average slope is determined for the equations.

The average slope for the BVH (or $\phi_o$) equations for the $\phi$ term is 1.467, and the intercept is adjusted by the ratio of actual slope/new slope. The normalized equations are:

| | (slope) (intercept) |
|---|---|
| $P_c$ = 1 | BVH = 1.467 $\phi$ - .24217 |
| 3.2 | BVH = 1.467 $\phi$ - .20120 |
| 6.2 | BVH = 1.467 $\phi$ - .16667 |
| 10.2 | BVH = 1.467 $\phi$ - .14480 |

In this form, the intercept term (that is the numerical constants of each equation) varies with $P_c$, and thus with height above the water table. These intercepts may be related to the capillary pressure $P_c$.

When the in situ fluid densities $d_w$ (density of connate water) and $d_o$ (densities of oil in the zone) are obtained, the height above the water level is given by the equation $$h = \frac{K_1 P_c}{d_w - d_o} \text{ or } P_c = \frac{(d_w - d_o)h}{K_1}$$

In the Tom O'Connor Field it is known that $d_w = 1.03$ and $d_o = 0.69$ gm/cc and $K_1 = 2.3$. Thus, one $P_c$ unit is equivalent to 6.76 feet.

Figure 3D:
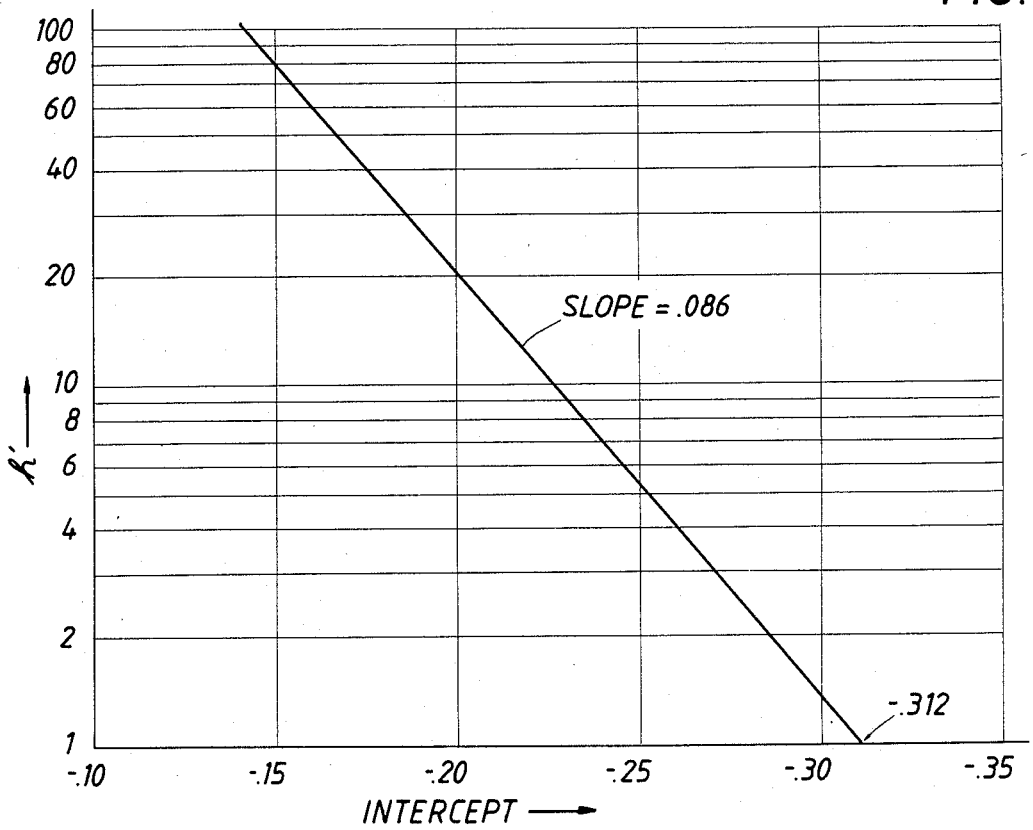

It has been found that the intercept of each normalized equation is functionally related to h. FIG. 3D shows a plot of log h vs the normalized intercept. The trend line gives two pieces of data: The value of the intercept where log h=0 (h=1') and the slope of the trend. For this case the log h=0 value is −0.312 and the slope is 0.086. This relationship is inserted in the normalized equations to produce a single general equation:

$$BVH = 1.467\ \phi_E - 0.312 + 0.086 \log h.$$

In general therefore, the bulk volume of oil BVH or $\phi_o$ can be expressed from capillary pressure measurements from core data as, $$\phi_o = C\phi_E - K + g \log h. \quad (1)$$

Figure 4:
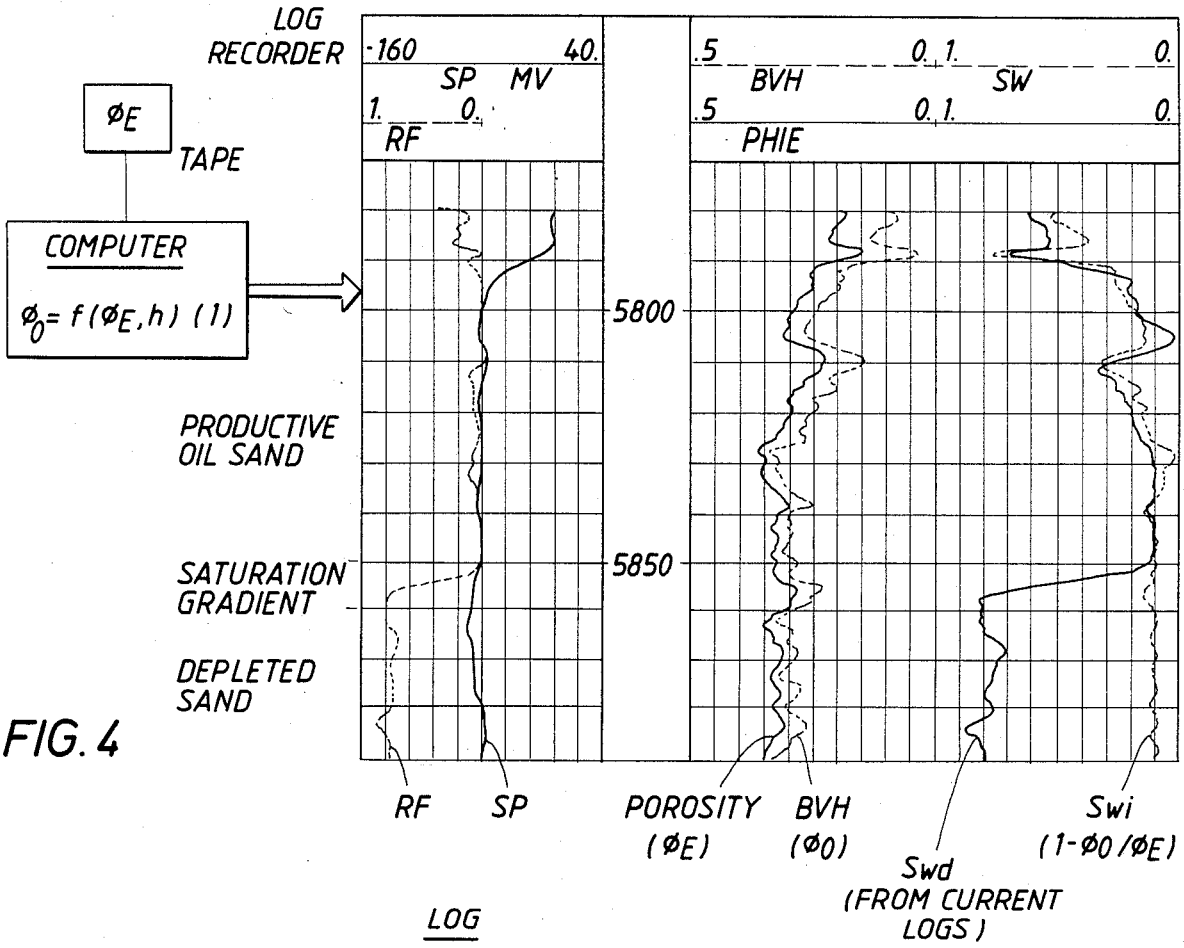
FIG. 4 is an illustration of the use of an effective porosity log previously obtained in combination with the bulk volume of oil relationship determined according to the invention to produce on a log recorder a log of $\phi_o$ and in combination with a log of Swd obtained from current logs to produce a log of recovery factor.

Equation (1) is useful to assess original bulk volume of oil $\phi_o$ or oil saturation, $S_o$, $$\left(S_o = \frac{\phi_o}{\phi_E}\right)$$

for a zone currently in production where a log of $\phi_E$ is available. Such an application of the use of core data from equation (1) is illustrated in FIG. 4 where the relation of the core data derived in equation (1) between $\phi_o$ and $\phi_E$ and h is combined with the original porosity $\phi_E$ from an open hole log to produce a recorded log of $\phi_o$ versus depth. The initial water saturation $S_{wi}=(1-\phi_o/\phi_E)$ is also presented on the log.

One of the problems facing a reservoir engineer is to obtain an appropriate recovery factor (RF) for a pay zone. The methods of this invention for developing a log of original water saturation $S_{wi}$ may be used to develop such a recovery factor log for a water-drive depleted zone.

For example, the present water saturation of a water-drive depleted zone $S_{wd}$ may be determined from current logs. The recovery factor is defined as $$RF = \frac{S_{wd} - S_{wi}}{1 - S_{wi}}.$$

For a given depleted zone, the RF may be plotted as a function of depth as illustrated in FIG. 4 as a log. The recovery factor may be applied to other wells in the field to provide better estimates for expected primary oil production. The RF log may be used to indicate whether or not actual production has met expected production.

Also shown on the log of FIG. 4 is the typical SP log. The RF log helps to distinguish the productive oil sand from the depleted oil sand.

For old wells however, porosity logs may not be available. If an original resistivity log exists for the well, it can be used to estimate bulk volume of oil and saturation that originally existed before production.

It is known that the bulk volume of water, BVW or $\phi_w$ of a formation can be expressed as $$\phi_w = \left(\frac{R_w}{R_t}\right)^{\frac{1}{n}}.$$

For said formations, n is usually from 1.8 to 2.0. Using the relationship, $$\phi_E=\phi_w+\phi_o,$$

equation (1) may be rearranged to the form, $$\phi_o = \frac{1}{1-C}\,[C(\phi_w) - K + g \log h], \text{ or} \qquad (2)$$

$$\phi_o = \frac{1}{1-C}\left[C\left(\frac{R_w}{R_t}\right)^{\frac{1}{n}} - K + g \log H\right].$$

Figure 5:
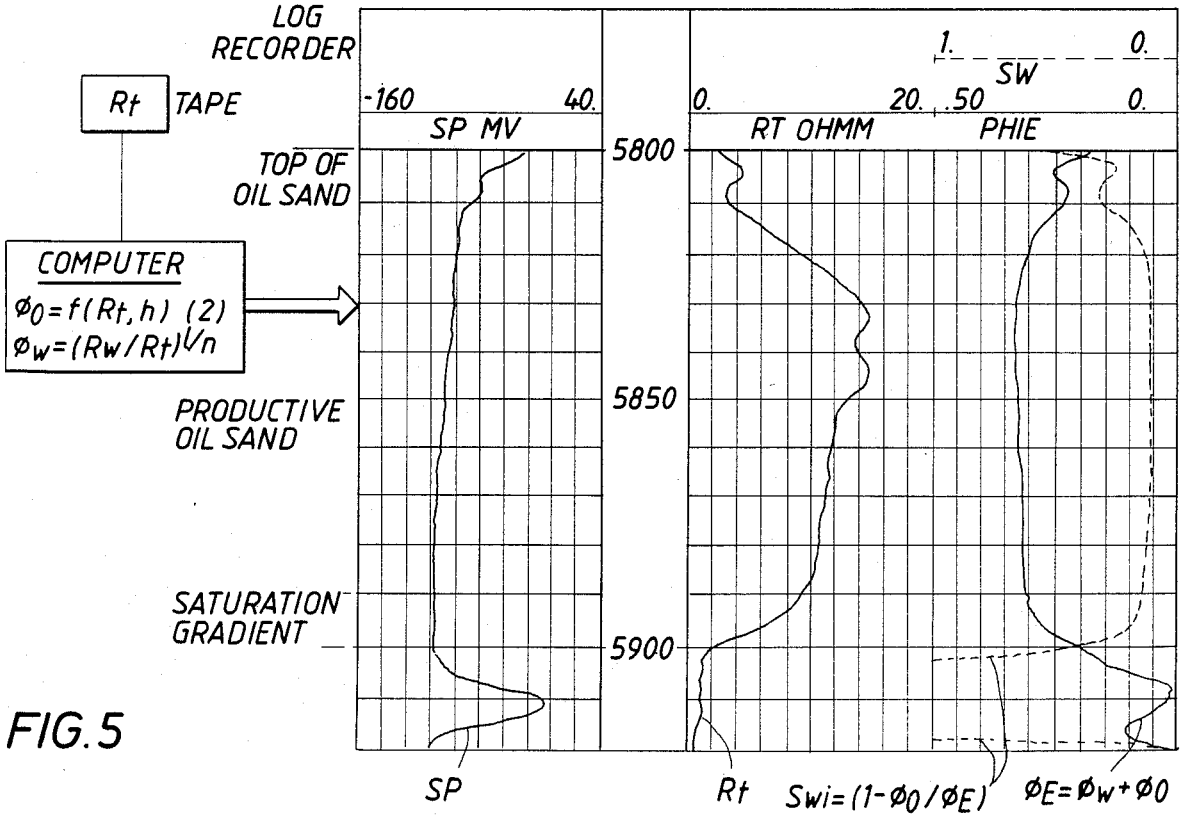
FIG. 5 illustrates a computer and log recorder with which the relationship determined from the steps of FIG. 3 is combined with an $R_t$ log to produce $\phi_E$ log versus depth.

FIG. 5 illustrates the case where $R_t$ as a function of depth is combined with the core data derived relationship of equation (2) to generate an original Bulk Volume of Oil log $\phi_o$ which with the relation $\phi_W=(R_w/R_t)^{1/n}$ and $\phi_E=\phi_W+\phi_o$ allows the production of the log of $\phi_E$. The original water saturation $S_{wi}$ is determined and recorded from the relationship, $$S_{wi}=1-S_o=(1-\phi_o/\phi_E).$$

The computed logs $\phi_E$ and $S_{wi}$ are presented on FIG. 4 along with the original logs of $R_t$ and $S_p$. The computed logs clearly illustrate the boundaries of an oil sand.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. A method for determining bulk volume of oil (BHO or $\phi_o$) as a function of depth and effective porosity in a zone of a produced well in which a log of effective porosity $\phi_E$ exists comprising the steps of:

obtaining core samples from said zone corresponding to said zone of said produced well, testing said core samples to determine a first relationship of bulk volume of oil (BVO or $\phi_o$) as a function of capillary pressure $P_c$ and effective porosity $\phi_E$, that is, $\phi_o=f(\phi_E, P_c)$, determining the correspondence between capillary pressure, $P_c$ and height h above the oil-free water contact of the zone of the form, $$P_c = \frac{(d_w - d_o)h}{K_1}$$

where $d_w$ is the density of the connate water of the zone, $d_o$ is the density of oil in the zone, and $K_1$ is a constant of proportionality, determining a second relationship of bulk volume of oil (BVO) as a function of total porosity $\phi_E$ of the formation and height h above the oil water contact depth of the zone of the form, $$\phi_o=C\phi_E-K+g \log h,$$

where C, K, and g are numerical constants, and recording a log of $\phi_o$(h) from said second relationship by combining $\phi_E$(h) data from a log of effective porosity for said zone.

2. The method of claim 1 wherein the step of obtaining core samples comprises the sub steps of forming a new well in the field in which said produced well is formed, and obtaining core samples from said new well in a zone corresponding to said zone of said produced well.

3. The method of claim 1 wherein $\phi_o=f(\phi_E, P_c)$ is a plurality of straight line approximations to measure data for various constant values of capillary pressure for the core, $$\begin{array}{lllllll} \phi_{o1} & = & a_1\phi_E & - & b_1 & \text{for} & P_c = C_1 \\ . & & . & & . & & . \\ . & & . & & . & & . \\ . & = & . & - & . & \text{for} & . = . \\ \phi_{on} & & a_n\phi_E & & b_n & & P_c \quad C_n, \end{array}$$

and the step of determining the relationship, $\phi_o = C\phi_E - K + g \log h$ comprises the sub steps of, determining average slopes and new intercepts for each of said straight line approximations to measured data, $$\begin{array}{lllllll} \phi_{o1} & = & C\phi_E & - & b_1^1 & \text{for} & P_c = C_1 \\ . & & . & & . & & . \\ . & & . & & . & & . \\ . & = & . & - & . & \text{for} & = . \\ \phi_{on} & & C\phi_E & & b_n^1 & & P_c \quad C_n \end{array}$$

$$\text{where } C = \frac{a_1 + \ldots a_n}{n}$$

and $b_1^1 \ldots b_n^1$ are new intercept values where $\phi_E = 0$, and determining the relationship between said new intercept values $b_1^1$; $P_c = C_1 \ldots b_n 1 : P_c = C_n$ to said relationship between $$h = \frac{P_c K_1}{d_w - d_o}$$

of th form $b_n^1 = -K + g \log h$.

4. The method of claim 1 further comprising the step of determining the water saturation, $S_w(h)$ of the zone before production of oil from it by dividing $\phi_w(h)$ of the zone before production of oil from it by $\phi_E(h)$, that is, $$S_w(h) = \frac{\phi_w(h)}{\phi_E(h)}, \text{ or equivalently } 1 - \frac{\phi_o(h)}{\phi_E(h)}$$

and recording of $S_w(h)$.

5. The method of claim 4 further comprising the steps of determining the present water saturation $S_{wd}$ of a depleted zone from current logs of the zone, determining a recovery factor, $$RF = \frac{S_{wd} - S_w}{1 - S_w},$$

and recording said recovery factor as a function of depth in the zone.

6. A method for determining bulk volume of oil $\phi_o$ as a function of depth and original resistivity $R_t$ in a zone of a produced well for which a resistivity log $R_t$ as a function of depth exists but no effective porosity log as a function of depth exists comprising the steps of:

obtaining core samples from said zone corresponding to said zone of said produced well, testing said core samples to determine a first relationship of bulk volume of oil (BVO or $\phi_o$) as a function of capillary pressure $P_c$ and effective porosity $\phi_E$, that is, $\phi_o = f(\phi_E, P_c)$, determining the correspondence between capillary pressure, $P_c$ and height h above the oil-free water contact of the zone of the form, $$h = \frac{P_c K_1}{d_w - d_o}$$

where $d_w$ is the density of the connate water of the zone, $d_o$ is the density of oil in the zone, and $K_1$ is a constant of proportionality, determining a second relationship of bulk volume of oil (BVO or $\phi_o$) as a function of total porosity $\phi_E$ of the formation and height h above the oil water contact depth of the zone of the form, $$\phi_o = C\phi_E - K + g \log h,$$

where C, K, and g are numerical constants, estimating the Bulk Volume of Water as a function of depth (BVW or $\phi_w(d)$) for said zone as $$\phi_w(d) = \left(\frac{R_w}{R_t(d)}\right)^{\frac{1}{n}}$$

where $R_w$ is the resistivity of the connate water of the zone and n is an emperically derived constant, determining the original Bulk Volume of Oil of the zone in the produced well $\phi_o$ as a function of depth as $$\phi_o(h) = \frac{1}{1 - C}\left[C\left(\frac{R_w}{R_t(h)}\right)^{\frac{1}{n}} - K + g \log h\right]$$

where the height h above the oil water contact point is matched to the depth of the corresponding to $R_t(d)$, and recording $\phi_o(h)$.

7. The method of claim 6 further comprising the step of adding $\phi_w(h)$ and $\phi_o(h)$ to derive a log of total porosity of the produced well as it was before production of oil from it, that is, $$\phi_E(h) = \phi_w(h) + \phi_o(h),$$

and recording $\phi_E(h)$.

8. The method of claim 7 further comprising the step of determining the water saturation, $S_w(h)$ of the zone before production of oil from it by dividing $\phi_w(h)$ of the zone before production of oil from it by $\phi_E(h)$, that is, $$S_w(h) = \frac{\phi_w(h)}{\phi_E(h)}, \text{ or equivalently } 1 - \frac{\phi_o(h)}{\phi_E(h)}$$

and recording of $S_w(h)$.

9. The method of claim 8 further comprising the steps of determining the present water saturation $S_{wd}$ of a depleted zone from current logs of the zone, determining a recovery factor, $$RF = \frac{S_{wd} - S_w}{1 - S_w},$$

and recording said recovery factor as a function of depth in the zone.

* * * * *